US010548409B2

(12) United States Patent
Schulz, Jr.

(10) Patent No.: US 10,548,409 B2
(45) Date of Patent: Feb. 4, 2020

(54) COMFORT CONTROL INSERT FOR A MATTRESS AND FOUNDATION

(71) Applicant: Rock Island Industries, Inc., Hempstead, TX (US)

(72) Inventor: Martin Schulz, Jr., Brenham, TX (US)

(73) Assignee: Rock Island Industries, Inc., Hempstead, TX (US)

( * ) Notice: Subject to any disclaimer, the term of this patent is extended or adjusted under 35 U.S.C. 154(b) by 466 days.

(21) Appl. No.: 15/420,860

(22) Filed: Jan. 31, 2017

(65) Prior Publication Data

US 2017/0251816 A1 Sep. 7, 2017

Related U.S. Application Data

(60) Provisional application No. 62/304,610, filed on Mar. 7, 2016.

(51) Int. Cl.

| | |
|---|---|
| ***A47C 23/06*** | (2006.01) |
| ***A47C 23/00*** | (2006.01) |
| ***A47C 31/12*** | (2006.01) |

(52) U.S. Cl.

CPC ..... *A47C 23/06* (2013.01); *A47C 23/002* (2013.01); *A47C 23/062* (2013.01); *A47C 23/064* (2013.01); *A47C 23/068* (2013.01); *A47C 31/123* (2013.01)

(58) Field of Classification Search

CPC ... A47C 19/025; A47C 19/027; A47C 20/027; A47C 21/06; A47C 23/002; A47C 23/007; A47C 23/06; A47C 23/064; A47C 23/068; A47C 27/087; A47C 31/123; A47C 23/062; A47C 23/063

See application file for complete search history.

(56) References Cited

U.S. PATENT DOCUMENTS

| | | | | | |
|---|---|---|---|---|---|
| 1,427,020 | A * | 8/1922 | Rooks | A47C 23/06 | 5/211 |
| 2,551,976 | A * | 5/1951 | Smith | A47C 19/027 | 5/236.1 |
| 2,616,100 | A * | 11/1952 | Lee | A47C 23/06 | 5/236.1 |
| 2,638,606 | A * | 5/1953 | Austin | A47C 23/063 | 5/236.1 |
| 3,280,515 | A * | 10/1966 | Eriksson | A47C 19/027 | 5/659 |

(Continued)

*Primary Examiner* — David R Hare

(74) *Attorney, Agent, or Firm* — Barnes & Thornburg LLP

(57) ABSTRACT

An insert adapted to be inserted between a foundation of a bed and a mattress of the bed. The insert includes a frame having a first side rail and a second side rail spaced apart from the first side rail. A plurality of elongate upper slats extend between the first side rail and the second side rail of the frame at a first level with respect to the frame and are spaced apart from one another. A plurality of elongate lower slats extend between the first side rail and the second side rail of the frame at a second level located below the first level of the upper slats. Each lower slat is located below a gap formed between a pair of adjacent upper slats. A mounting member resiliently supports the ends of two adjacent upper slats and rigidly supports the end of a lower slat that is located below the gap formed between the two adjacent upper slats, whereby the firmness of a mattress overlying the insert can be selectively adjusted.

16 Claims, 4 Drawing Sheets

(56) References Cited

U.S. PATENT DOCUMENTS 4,074,372 A 2/1978 Schulz, Jr.
4,222,134 A * 9/1980 Degen ..... A47C 23/064 5/191
4,251,891 A * 2/1981 Degen ..... A47C 23/064 5/191
4,567,615 A * 2/1986 Fanti ..... A47C 23/068 5/191
4,644,596 A * 2/1987 Husler ..... A47C 23/06 5/191
4,752,981 A * 6/1988 Salens ..... A47C 23/067 5/238
5,280,658 A * 1/1994 Sigl ..... A47C 23/061 5/191
5,282,285 A * 2/1994 de Gelis ..... A47C 23/063 5/237
5,924,149 A * 7/1999 Weber ..... A47C 23/066 5/237
6,073,281 A * 6/2000 Huber ..... A47C 23/064 5/236.1
6,219,863 B1 * 4/2001 Loberg ..... A47C 19/005 5/200.1
6,711,762 B2 * 3/2004 Olenick ..... A47C 17/64 297/63
6,877,174 B2 * 4/2005 Lobry ..... A47C 23/064 5/236.1
6,983,497 B2 * 1/2006 Lobry ..... A47C 23/0431 5/236.1
7,621,004 B2 * 11/2009 Lobry ..... A47C 23/064 5/236.1
8,042,205 B2 10/2011 Schulz, Jr.
8,091,161 B1 1/2012 Schulz, Jr. et al.
8,176,581 B2 5/2012 Schulz, Jr.
8,191,186 B2 * 6/2012 Lobry ..... A47C 23/062 5/236.1
8,782,828 B2 7/2014 Schulz, Jr. et al.
8,959,678 B2 2/2015 Schulz, Jr.
9,072,387 B2 * 7/2015 Lobry ..... A47C 23/067
9,241,579 B2 * 1/2016 Gandolfi ..... A47C 23/063
2004/0107499 A1 * 6/2004 Verschuere ..... A47C 23/064 5/236.1

* cited by examiner

COMFORT CONTROL INSERT FOR A MATTRESS AND FOUNDATION

RELATED APPLICATIONS

This application claims the benefit of U.S. Provisional Application 62/304,610, filed Mar. 7, 2016.

BACKGROUND

The present disclosure is directed to an insert that is adapted to be located between the foundation and the mattress of a bed. Two inserts are adapted to be located side-by-side between the foundation and the mattress of a Queen or King size bed such that the firmness of each half of the mattress can be individually adjusted to suit the preferences of the individual user of that half of the mattress.

DETAILED DESCRIPTION

Figure 1:
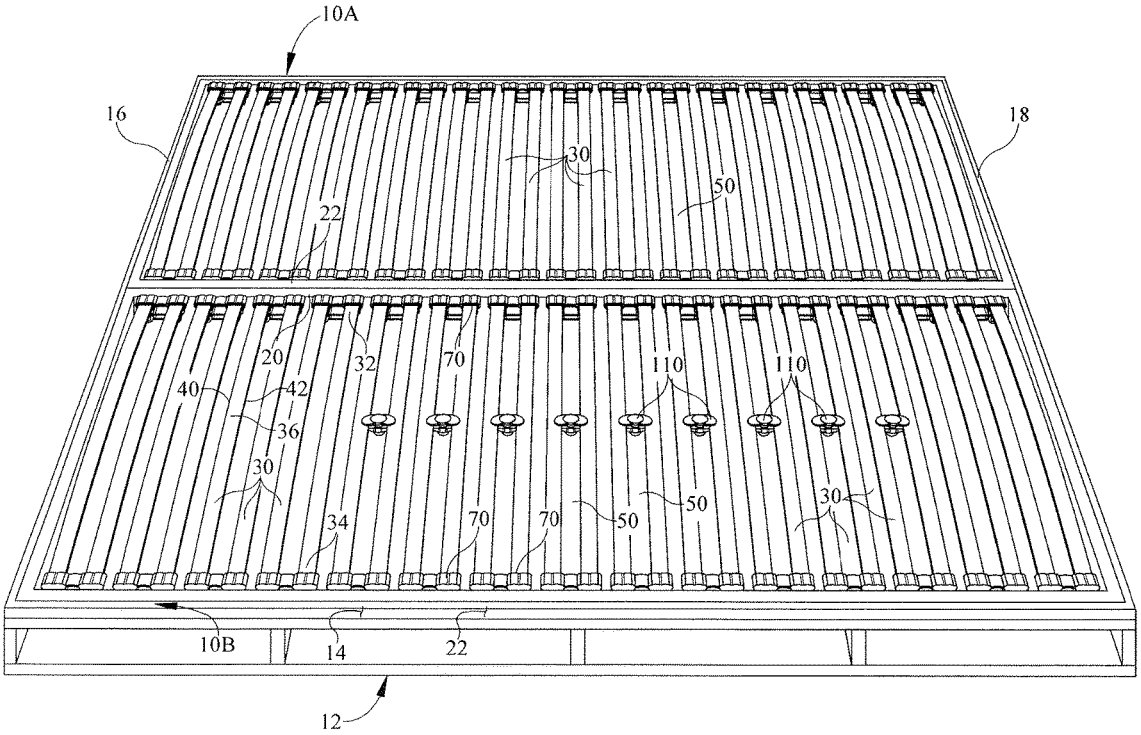
FIG. 1 is a perspective view of two inserts of the present disclosure located side-by-side, shown with firmness adjustment members in one insert.
Figure 2:
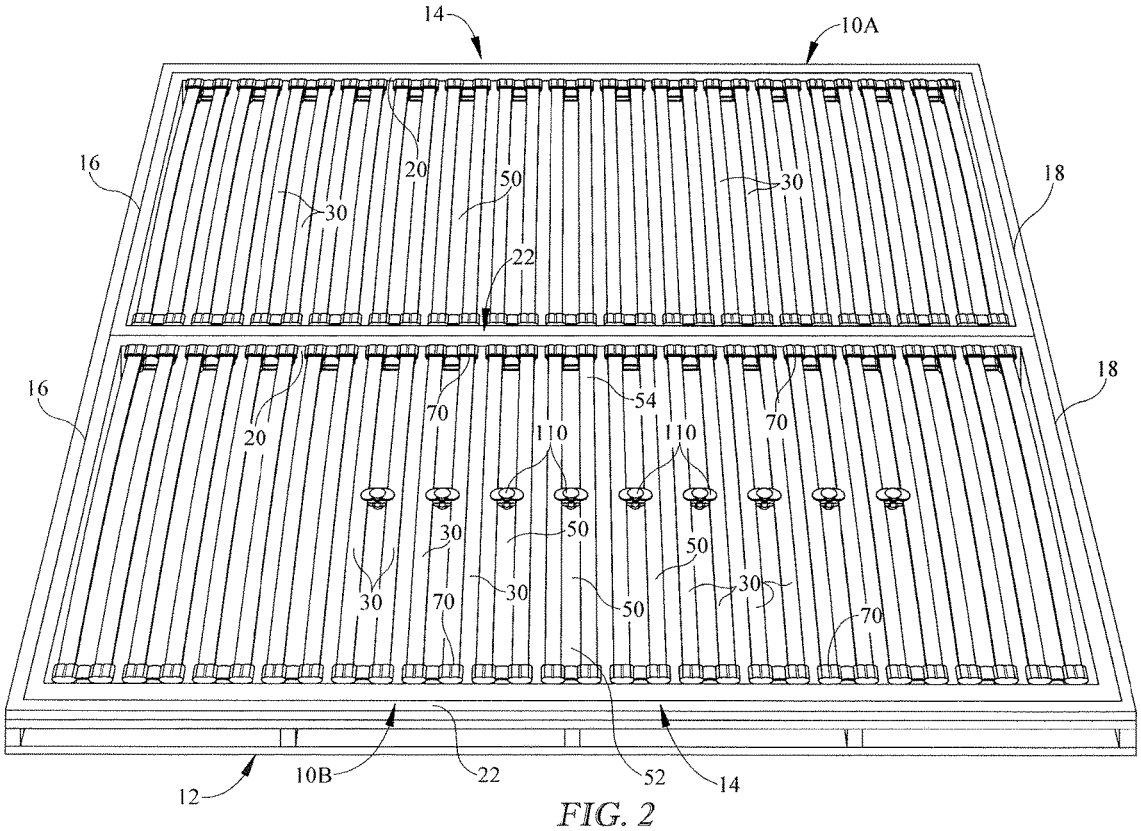
FIG. 2 is another perspective view of the two inserts shown in FIG. 1.
Figure 4:
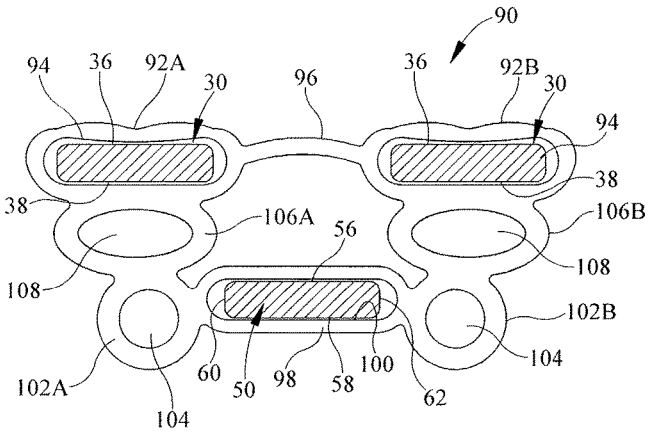
FIG. 4 is a front elevational view of the slat holder of the slat mounting member with upper slats and a lower slat coupled thereto.
Figure 3:
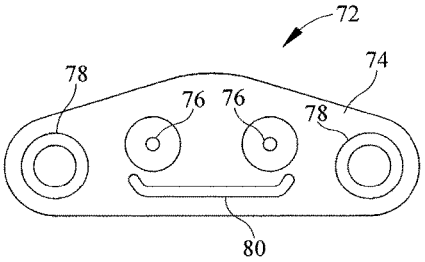
FIG. 3 is a front elevational view of the connector member of the slat mounting member.
Figure 5:
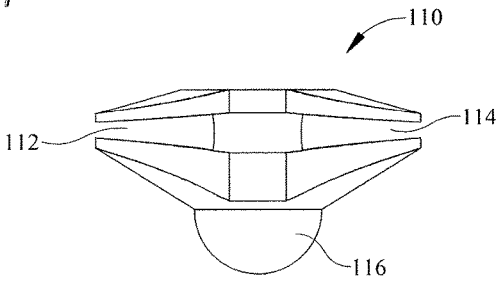
FIG. 5 is a front elevational view of the firmness adjusting member.
Figure 7:
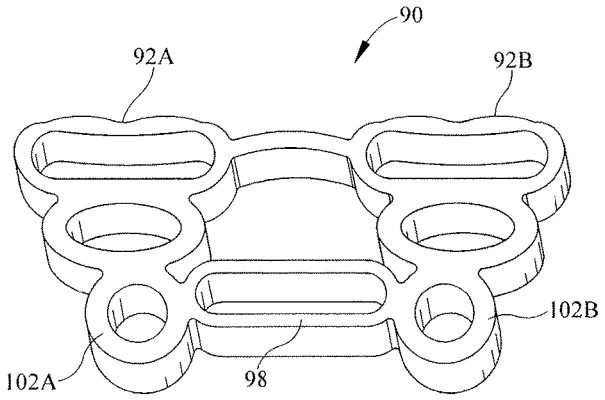
FIG. 7 is a further front elevational view of the slat holder of the slat mounting member.
Figure 6:
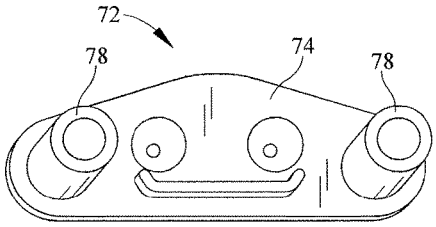
FIG. 6 is a further front elevational view of the connector member of the slat mounting member.
Figure 8:
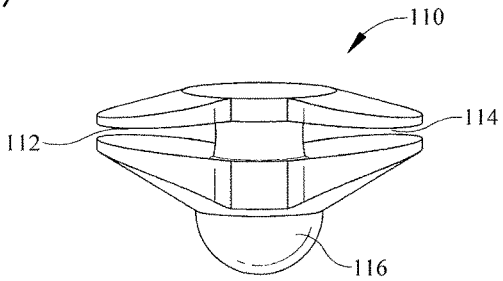
FIG. 8 is a further front elevational view of the firmness adjusting member.

The present disclosure relates to a firmness adjusting insert adapted to be inserted between the foundation and the mattress of a bed. Two inserts 10A and 10B are shown in FIGS. 1 and 2 located in a side-by-side arrangement. The inserts 10A and 10B are adapted to overlie and be supported by a foundation 12 of a bed. The mattress of the bed, such as a Queen or King size mattress, is adapted to overlie and be supported by the inserts 10A and B. The inserts 10A and 10B are approximately 2.5 inches tall.

Each insert 10A and B includes a generally rectangular frame 14 having a generally linear first end rail 16 and a generally linear second end rail 18 that is spaced apart from and generally parallel to the first end rail 16. Frame 14 also includes a generally linear first side rail 20 and a generally linear second side rail 22 that is spaced apart from and generally parallel to first side rail 20. First side rail 20 and second side rail 22 extend generally transversely between first end rail 16 and second end rail 18 and are connected thereto.

Each insert 10A and B includes a plurality of upper slats 30 that extend generally linearly between a first end 32 and a second end 34. Each upper slat 30 includes a generally planar top surface 36 and a generally planar bottom surface 38 that is spaced apart from and parallel to top surface 36. Each upper slat 30 also includes a generally linear first side edge 40 that extends between first end 32 and second end 34 of slat 30. Each upper slat 30 also includes a generally linear second side edge 42 that extends between first end 32 and second end 34 of slat 30 and that is generally parallel to first side edge 40. Upper slat 30 has a thickness that extends between top surface 36 and bottom surface 38 and a width that extends between first side edge 40 and second side edge 42. The width of each upper slat 30 is several times greater than the thickness of the slat 30. Upper slats 30 extend generally transversely between first side rail 20 and second side rail 22. Upper slats 30 are located generally coplanar with one another at a first level with respect to the frame 14 and are generally parallel and spaced apart from one another creating an elongate gap between adjacent upper slats 30. Upper slats 30 are located along the length of side rails 20 and 22. Upper slats 30 may have an upward bow or arch and are generally rectangular or obround in cross section.

Each insert 10A and B includes a plurality of lower slats 50 that extend generally linearly between a first end 52 and a second end 54. Each lower slat 50 includes a generally planar top surface 56 and a generally planar bottom surface 58 that is spaced apart from and parallel to top surface 56. Each lower slat 50 also includes a generally linear first side edge 60 that extends between the first end 52 and second end 54 of slat 50. Each lower slat 50 also includes a generally linear second side edge 62 that extends between first end 52 and second end 54 of lower slat 50 and that is generally parallel to first side edge 60. Lower slat 50 has a thickness that extends between top surface 56 and bottom surface 58 and a width that extends between first side edge 60 and second side edge 62. Lower slats 50 are generally rectangular or obround in cross section. The width of each lower slat 50 is several times greater than the thickness of the slat 50. Lower slats 50 extend generally transversely between first side rail 20 and second side rail 22 of frame 14. Lower slats 50 are spaced apart from one another and are located generally coplanar with one another at a second level with respect to the frame that is below the first level of the upper slats 30. Lower slats 50 are located generally elevationally below upper slats 30 with a lower slat 50 being located below each gap formed between two upper slats 30. Upper and lower slats 30, 50 may be made of wood or other materials. Various combinations of widths and thicknesses of the upper and lower slats 30, 50 may be used as desired to adjust the firmness provided by the inserts 10A, 10B.

First ends 32 of two adjacent upper slats 30 and first end 52 of a lower slat 50 are coupled to first side rail 20 of frame 14 by a mounting member 70. Second ends 34 of two adjacent upper slats 34 and second end 54 of a lower slat 50 are coupled to second side rail 22 of frame 14 by a mounting member 70. Mounting member 70 includes a connector member 72. Connector member 72 includes a generally planar plate 74 including a plurality of apertures 76. Connector member 72 also includes two spaced apart support members such as posts 78. Posts 78 are generally cylindrical and extend outwardly transversely from plate 74. Connector member 72 also includes a generally planar and horizontal shelf 80 that extends transversely outwardly from plate 74 and that is located generally between posts 78. Connector member 72 is adapted to be connected to a first side rail 20 or second side rail 22 of frame 14 by fasteners, such as screws or nails, that extend through apertures 76, such that plate 74 is in engagement with the first side rail 20 or second side rail 22. Connector member 72 may be made from a plastic material.

Each mounting member 70 also includes a slat holder 90. Each slat holder 90 includes spaced apart upper slat receptacles 92A-B. Each upper slat receptacle 92A-B includes a hollow chamber 94. A web 96 extends between and connects receptacle 92A and receptacle 92B together. Each slat holder 90 also includes a lower slat receptacle 98 having a hollow chamber 100. Slat holder 90 also includes two spaced apart post support receptacles 102A-B each having a hollow cylindrical aperture 104. Lower slat receptacle 98 extends between post support receptacles 102A-B. A shock absorber 106A is located between and connects upper slat receptacle 92A with support receptacle 102A. A shock absorber 106B is located between and connects upper slot receptacle 92B to support receptacle 102B. Each shock absorber 106A-B includes a hollow chamber 108 and is resiliently compressible. Slat holder 90 may be made from a resilient elastomeric material such as rubber.

Slat holder 90 is coupled to connector member 72 by removably inserting posts 78 of connector member 72 respectively into apertures 104 of post support receptacles 102A-B of slat holder 90. The bottom of lower slat receptacle 98 is supported by shelf 80 of connector member 72. The first end 32 or second end 34 of an upper slat 30 is removably inserted into and received in chamber 94 of upper slat receptacle 92A, and a first end 32 or second end 34 of an adjacent upper slat 30 is removably inserted into and received in chamber 94 of upper slat receptacle 92B. First end 52 or second end 54 of a lower slat 50 is removably inserted into and received within chamber 100 of lower slat receptacle 98. Lower slat 50 is thereby rigidly supported by shelf 80 of connector member 72. Upper slats 30 are respectively resiliently supported by shock absorbers 106A and 106B. The first end 32 and second end 34 of each upper slat 30 is coupled to frame 14 and resiliently supported by a respective slat holder 90. First end 52 and second end 54 of each lower slat 50 is generally rigidly supported by shelf 80 of connector member 72. Upper slats 30 are thereby generally resiliently supported at their first and second ends 32 and 34 such that upper slats 30 are resiliently moveable upwardly and downwardly to absorb shock forces and weight from the overlying mattress.

If desired, as shown in insert 10B of FIG. 1, one or both of the inserts 10A and B may include one or more firmness adjusting members 110. Firmness adjusting member 110 includes a first slot 112 adapted to receive a first side edge 40 of a first upper slat 30 and a second slot 114 adapted to receive a second side edge 42 of an adjacent second upper slat 30. Firmness adjusting member 110 is thereby coupled between two adjacent upper slats 30 in the gap therebetween. Firmness adjusting member 110 also includes a bumper 116 that is located below slots 112 and 114 and that is located elevationally below the bottom surfaces 38 of upper slats 30. Bumper 116 is located elevationally above a lower slat 50. Each firmness adjusting member 110 is located generally at the midpoint of the upper slats 30 generally equally between first side rail 20 and second side rail 22. Bumper 116 of firmness adjusting member 110 is adapted to engage top surface 56 of the lower slat 50 located there below such that the lower slat 50 assists in supporting the two upper slats 30 located in slots 112 and 114 of firmness adjusting member 110, thereby increasing the firmness of the support provided by the upper slats 30 to the mattress. One or more firmness adjusting members 110 can be located between one or more adjacent pairs of upper slats 30 as desired, and one or more firmness adjusting members 110 can be located between the same pair of adjacent upper slats 30 if desired, to thereby adjust the firmness of the support provided by the inserts 10A and 10B to the overlying mattress.

Various features of the invention have been particularly shown and described in connection with the illustrated embodiments of the invention. However, it must be understood that these particular arrangements merely illustrate and that the invention has been given its fullest interpretation.

What is claimed is:

1. An insert adapted to be inserted between a foundation of a bed and a mattress of the bed, the insert comprising:

a frame including a first side rail and a second side rail spaced apart from the first side rail;

a plurality of elongate upper slats extending between the first side rail and the second side rail of the frame at a first level with respect to the frame, the upper slats being spaced apart from one another such that a gap is formed between adjacent upper slats, the upper slats adapted to support the mattress;

a plurality of elongate lower slats extending between the first side rail and the second side rail of the frame at a second level located below the first level, the lower slats being spaced apart from one another, each lower slat being located below the gap formed between a pair of adjacent upper slats;

a plurality of mounting members, one or more mounting members adapted to couple the upper slats and the lower slats to the first side rail of the frame and one or more mounting members adapted to couple the upper slats and the lower slats to the second side rail of the frame;

each mounting member including a slat holder having a first upper slat receptacle, a second upper slat receptacle, and a lower slat receptacle, the first upper slat receptacle including a first chamber adapted to receive an end of a first upper slat, the second upper slat receptacle including a second chamber adapted to receive an end of a second upper slat, the lower slat receptacle including a chamber adapted to receive an end of a lower slat, a first shock absorber having a bottom end and a top end, the top end of the first shock absorber resiliently supporting the first upper slat receptacle, and a second shock absorber having a bottom end and a top end, the top end of the second shock absorber resiliently supporting the second upper slat receptacle, the second shock absorber being spaced apart from the first shock absorber, the lower slat receptacle being coupled to the bottom end of the first shock absorber and to the bottom end of the second shock absorber.

2. The insert of claim 1, wherein each slat holder includes a web connecting the first upper slat receptacle to the second upper slat receptacle.

3. The insert of claim 1, wherein each slat holder includes a first support member receptacle coupled to the bottom end of the first shock absorber, and a second support member receptacle coupled to the bottom end of the second shock absorber, the lower slat holder being coupled to the first support member receptacle and to the second support member receptacle.

4. The insert of claim 3, wherein each mounting member includes a connector member adapted to couple the slat holder to the frame, the connector member including a first support member adapted to be received in an aperture of the first support member receptacle of the slat holder and a second support member adapted to be received in an aperture of the second support member receptacle of the slat holder.

5. The insert of claim 1, wherein each mounting member includes a connector member adapted to couple the slat holder to the frame, the connector member including a shelf adapted to underlie and support the lower slat receptacle of the slat holder.

6. The insert of claim 1, including one or more firmness adjustment members located between and coupled to a pair of adjacent upper slats.

7. The insert of claim 6, wherein each firmness adjustment member includes a first slot adapted to receive a first upper slat, and a second slot adapted to receive a second upper slat.

8. The insert of claim 7, wherein each firmness adjustment member includes a bumper adapted to engage a lower slat.

9. A pair of inserts of claim 1 adapted to be located in a side-by-side arrangement between a foundation of a bed and a mattress of a bed such that the firmness of each side of the mattress respectively supported by an underlying insert can be individually adjusted.

10. A mounting member for coupling a plurality of slats to a frame of an insert adapted to be inserted between a foundation of a bed and a mattress of the bed, the mounting member comprising:

a slat holder having a first upper slat receptacle, a second upper slat receptacle, and a lower slat receptacle, the first upper slat receptacle including a first chamber adapted to receive an end of a first upper slat, the second upper slat receptacle including a second chamber adapted to receive an end of a second upper slat, the lower slat receptacle including a third chamber adapted to receive an end of a lower slat;

a first shock absorber having a bottom end and a top end, the top end of the first shock absorber being coupled to the first upper slat receptacle, the first shock absorber resiliently supporting the first upper slat receptacle; and a second shock absorber having a bottom end and a top end, the top end of the second shock absorber being coupled to the second upper slot receptacle, the second shock absorber resiliently supporting the second upper slat receptacle, the second shock absorber being spaced apart from the first shock absorber;

the lower slat receptacle being coupled to the bottom end of the first shock absorber and to the bottom end of the second shock absorber.

11. The mounting member of claim 10, wherein the slat holder includes a first support member receptacle coupled to the bottom end of the first shock absorber and a second support member receptacle coupled to the bottom end of the second shock absorber, the lower slat receptacle having a first end coupled to the first support member receptacle and a second end coupled to the second support member receptacle.

12. The mounting member of claim 10, wherein the slat holder includes a web coupling the first upper slat receptacle to the second upper slat receptacle.

13. The mounting member of claim 11, including a connector member for coupling the slat holder to the frame of the insert, the connector member including a first support member adapted to be removably received in an aperture of the first support member receptacle of the slat holder and a second support member adapted to be removably received in an aperture of the second support member receptacle of the slat holder.

14. The mounting member of claim 13, wherein the connector member includes a shelf adapted to underlie and rigidly support the lower slat receptacle of the slat holder.

15. The mounting member of claim 10, wherein the slat holder is formed from a resilient elastomeric material.

16. The mounting member of claim 11, wherein the lower slat receptacle of the slat holder extends between the first support member receptacle and the second support member receptacle.

* * * * *